United States Patent [19]

Sanders

[11] 4,094,080

[45] June 13, 1978

[54] BOOT OR SHOE HEATING DEVICE

[76] Inventor: James J. Sanders, 9409 S. Hillcrest Dr., Oklahoma City, Okla. 73159

[21] Appl. No.: 793,095

[22] Filed: May 2, 1977

[51] Int. Cl.[2] ..... A43B 7/02; A41D 17/00; A61F 7/06

[52] U.S. Cl. ..... 36/2.6; 36/2 R; 126/206

[58] Field of Search ..... 36/2.6, 136, 2 R; 126/204, 206

[56] References Cited

U.S. PATENT DOCUMENTS

| | | | |
|---|---|---|---|
| 1,183,001 | 5/1916 | Gleason | 36/2 R |
| 2,680,918 | 6/1954 | Behner | 36/2.6 |
| 4,023,282 | 5/1977 | Ziegelheafer | 36/2.6 |

FOREIGN PATENT DOCUMENTS

| | | | |
|---|---|---|---|
| 463,456 | 7/1928 | Germany | 36/2.6 |

*Primary Examiner*—Patrick D. Lawson
*Attorney, Agent, or Firm*—Robert K. Rhea

[57] ABSTRACT

A pair of superposed stitched together sections of fabric sheet material is longitudinally divided at one end portion to form a plurality of pockets respectively overlying the toe, instep and vamp portions of a boot or shoe. The fabric sections are removably secured to the boot. A flameless heater is disposed within each pocket.

1 Claim, 5 Drawing Figures

BOOT OR SHOE HEATING DEVICE

BACKGROUND OF THE INVENTION

1. Field of the Invention

The present invention relates to outdoor footwear and more particularly to a device for heating a boot or shoe.

2. Description of the Prior Art

Prior art devices, such as U.S. Pat. Nos. 1,761,829; 2,402,726; 2,298,299 and 3,977,093, for heating shoes or boots have generally comprised electrical resistance wiring disposed within the soles and uppers of shoes or boots with the wiring being connected with a self-contained or external source of electrical energy for generating heat to keep the wearer's feet warm. The principal objection to such shoe or boot heating devices is that the heating elements must be installed at the time of manufacture which increases the cost of the footwear.

This invention provides a way of heating existing footwear and is attached to such footwear only when the temperature requires additional heat for the wearer when out of doors. In warm seasons the device may be removed and stored for use in cold weather.

SUMMARY OF THE INVENTION

A pair of rectangular superposed sections of fabric sheet material are longitudinally stitched together along marginal sides, after being longitudinally slit from one end portion and transversely stiched together adjacent the inward limit of the slit, to form a plurality of pockets to respectively overlie the toe, instep and vamp portions of a boot or shoe. The divided ends of the fabric are secured around the heel of the footwear by laces. The toe portion of the fabric is attached to the footwear by a rod-like member underlying the toe portion of the sole and attached to opposite sides of the toe portion of the fabric. The pockets contain a like plurality of flameless heat generating heaters for heating the shoe or boot.

The principal object of this invention is to provide a fabric casing containing a plurality of heat generating units which may be connected with the exterior of a shoe or boot for keeping the wearer's feet warm.

DESCRIPTION OF THE PREFERRED EMBODIMENT

Figure 1:
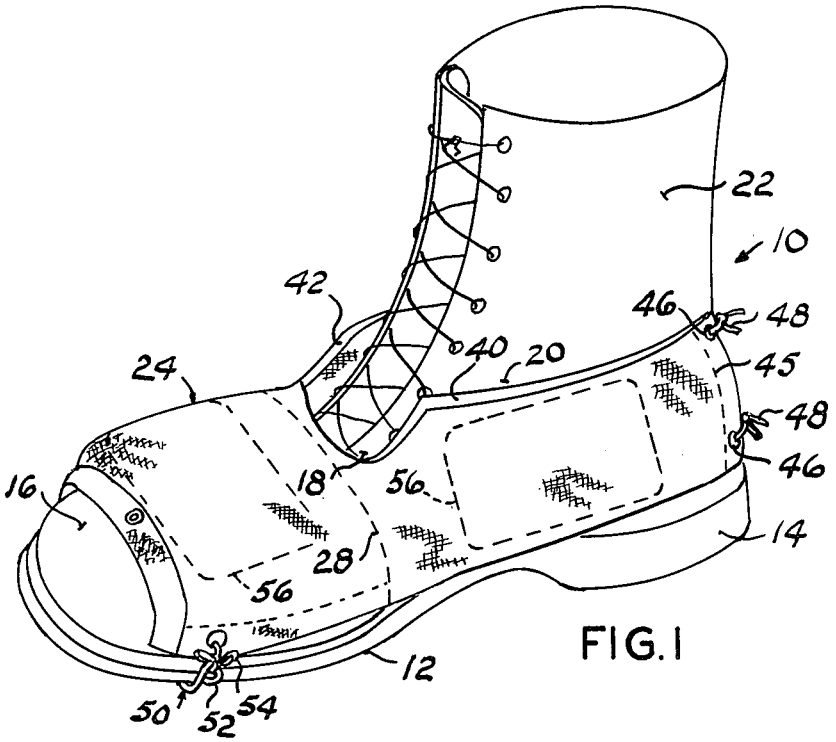
FIG. 1 is a perspective view of the device attached to a boot.
Figure 5:
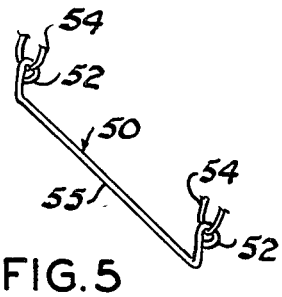
Figure 3:
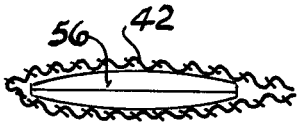
FIGS. 3 and 4 are fragmentary vertical cross sectional views taken substantially along the lines 3—3 and 4—4 of FIG. 2, respectively; and, FIG. 5 is a fragmentary perspective view of the toe end portion fastening member.
Figure 4:
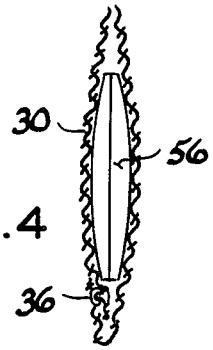

Like characters of reference designate like parts in those figures of the drawings in which they occur.

In the drawings:

The reference numeral 10 indicates a substantially conventional boot having a sole 12, a heel 14, a toe portion 16, an instep portion 18, vamps 20 and uppers 22.

The numeral 24 indicates a casing overlying the toe, instep and vamp portions of the boot 10 and surrounding the heel end portion of the boot. The casing 24 is formed from two rectangular sections of superposed fabric sheet material stitched together along marginal edges, as at 26, and transversely stitched together intermediate their ends, as at 28, to form a toe and instep pocket covering portion 30 open at the forward end 32 of the casing. Fabric, formed from synthetic material, has proven satisfactory.

The end of the toe pocket forming portion 30 is provided with a flap portion 34 overlying the upper section of fabric and secured thereto by a snap fastener 36. Adjacent the end 32, the lateral sides of the toe pocket portion 30 is provided with a pair of eyelets 38 for connecting the toe pocket portion 30 to the boot 10 as presently explained.

Figure 2:
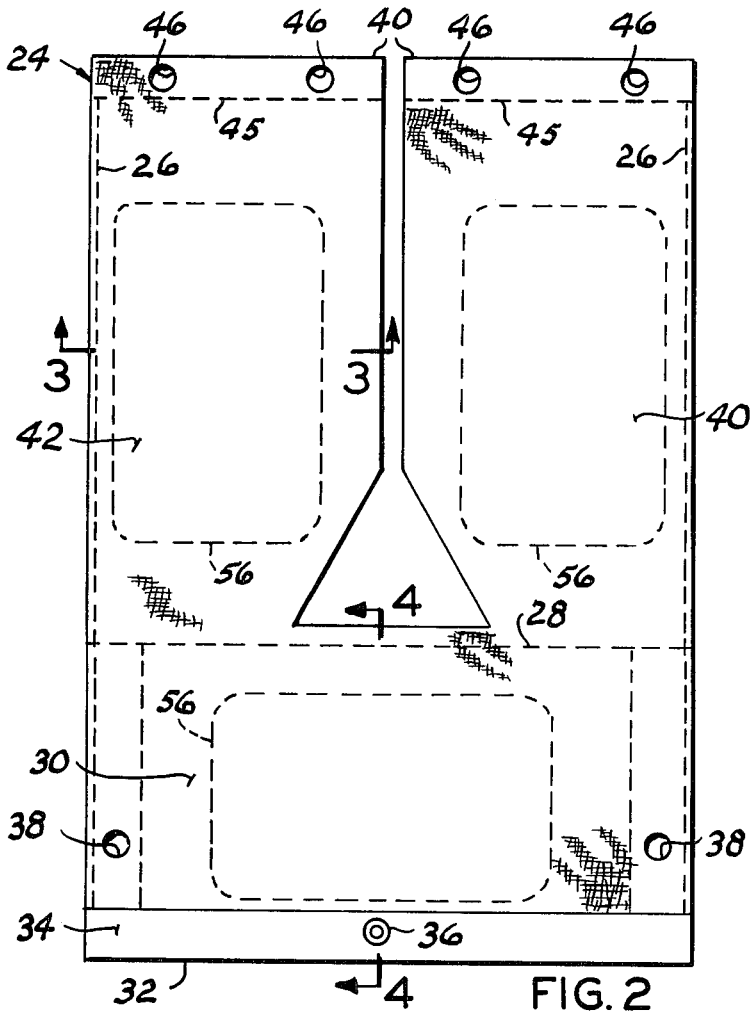
FIG. 2 is a plan view illustrating the preferred manner of forming the heating unit containing device.

Both layers of fabric are longitudinally slit or divided rearwardly of the stitching 28 from the stitched together rearward end 40 of the casing to define opposing side pockets 42 and 44 with both pockets being open at their confronting edges, as viewed in FIG. 2. The rearward end of the casing pockets 42 and 44 is reinforced by doubled back portions of the fabric and stitching 45 and is provided with a plurality of eyelets 46 for receiving laces or strands 48 to secure the casing to the shoe.

A rod-like toe clip 50, flat U-shaped in general configuration, has each end portion of its legs arcuately curved to form closed loops 52 for receiving similar laces or strands 54 which are respectively entrained through the eyelets 38 to secure the pocket portion 30 to the boot with the bight portion 55, of the U-shaped toe clip underlying the toe end portion of the boot sole 12.

Prior to placing the casing 24 on the boot, a hand warmer 56 is placed within the respective pocket 30, 42 and 44. The hand warmer 56 is conventional and an example thereof is disclosed by U.S. Pat. No. 2,579,620. A plurality of charcoal sticks, not shown, are preferably used as fuel for the hand warmers 56. The charcoal sticks are ignited prior to placing the hand warmers within the pockets.

OPERATION

In operation the hand warmers 56 are ignited and placed within the respective pockets and the casing 24 is connected with the boot 10, as described hereinabove.

Obviously the invention is susceptible to changes or alterations without defeating its practicability. Therefore, I do not wish to be confined to the preferred embodiment shown in the drawings and described herein.

I claim:

1. A footwear heating device, comprising:

a superposed pair of elongated fabric sheet material sections adapted to overlie and be secured, in a partial wraparound fashion, to the toe and vamp areas of a shoe or boot, said sections being stitched together to form a plurality of pockets;

a like plurality of flameless heaters disposed within said pockets;

a plurality of eyelets secured to the respective stitched together end portions of said sections;

a plurality of flexible strands extending through and joining oppositely disposed cooperating pairs of said eyelets in one said end portion;

a toe clip comprising a U-shaped rod adapted to extend transversely across the depending surface of the toe portion of a shoe or boot, said toe clip having arcuately curved legs forming a pair of closed loops; and, other flexible strands joining said closed loops to cooperating eyelets in the other said end portion.

* * * * *